US005398765A

United States Patent [19]

Worthington

[11] Patent Number: 5,398,765

[45] **Date of Patent: * Mar. 21, 1995**

[54] MOBILE MODULAR FOAM FIRE SUPPRESSION APPARATUS WITH IN-LINE BALANCED PRESSURE PROPORTIONING MODULE

[75] Inventor: Robert F. Worthington, Artesia, N. Mex.

[73] Assignee: Navajo Refining Company, Artesia, N. Mex.

[ * ] Notice: The portion of the term of this patent subsequent to Aug. 31, 2010 has been disclaimed.

[21] Appl. No.: 110,910

[22] Filed: Aug. 24, 1993

Related U.S. Application Data

[62] Division of Ser. No. 759,326, Sep. 13, 1991, Pat. No. 5,240,078.

[51] Int. Cl.[6] ..... A62C 27/00

[52] U.S. Cl. ..... 169/52; 169/13; 169/14; 169/67

[58] Field of Search ..... 169/13, 14, 15, 16, 169/24, 47, 52, 67

[56] References Cited

U.S. PATENT DOCUMENTS

| | | | |
|---|---|---|---|
| 3,220,482 | 11/1965 | Eveleth | 169/52 X |
| 4,037,664 | 7/1977 | Gibson | 169/24 X |
| 4,436,487 | 3/1984 | Purvis et al. | 169/13 X |
| 4,729,434 | 3/1988 | Rohrbach | 169/24 |
| 4,875,526 | 10/1989 | Latino et al. | 169/24 |
| 5,240,078 | 8/1993 | Worthington | 169/47 |

FOREIGN PATENT DOCUMENTS

| | | | |
|---|---|---|---|
| 1385918 | 3/1975 | United Kingdom | 169/24 |

*Primary Examiner*—David M. Mitchell
*Assistant Examiner*—Andrew C. Pike
*Attorney, Agent, or Firm*—Jefferson Perkins

[57] ABSTRACT

A mobile modular fire suppression apparatus (10) includes a platform (12) which may take the form of a skid. The platform (12) has mounted thereon a foam concentrate pump (34), an output of which is connected to a foam concentrate inlet of an in-line balanced pressure proportioning module (200). A water inlet (42) of the proportioning module (200) is connected to a pressurized water intake manifold (20) that is preferably disposed on a rear side of the skid (12). Foam concentrate intake lines (60), return lines (100), and foam solution discharge conduits (120) have ports on the left and right sides of the skid. By use of remote foam concentrate supply vessels (16) and a plurality of standard municipal water pumper trucks (14), the invention permits the creation and distribution of a large volume of fire fighting foam at a low capital cost.

15 Claims, 4 Drawing Sheets

MOBILE MODULAR FOAM FIRE SUPPRESSION APPARATUS WITH IN-LINE BALANCED PRESSURE PROPORTIONING MODULE

RELATED APPLICATION

This application is a division of application Ser. No. 07/759,326, filed Sep. 13, 1991 and assigned to Navajo Refining Company, the assignee hereof, now issued as U.S. Pat. No. 5,240,078.

TECHNICAL FIELD OF THE INVENTION

The present invention relates to mobile fire suppression apparatus, and, more particularly, to a mobile modular foam fire suppression apparatus designed for use where high volume water or foam solution application rates and densities are required.

BACKGROUND OF THE INVENTION

Fighting large fires, particularly in environments where fires can spread rapidly, requires use of high volume water or foam solution application rates and densities.

In-line balanced pressure proportioning modules are well known in the art. These in-line balanced pressure proportioning modules are located at a point in the fire suppression system to accurately supply proportioned foam solution. The principle of operation is based on the use of two orifices: one for the water supply and one for the foam concentrate supply, with both orifices discharging into a common reduced pressure area. The water is supplied by a water pump at the required pressure, and the foam liquid is supplied from another pump or other pressure source. These proportioners automatically balance the foam liquid pressure and water pressure to provide correct proportioning, even though the water pressure may vary at points in the system. In-line balanced pressure proportioning modules are available on the market from such manufacturers as National Foam, 150 Gordon Drive, Lionville, Pa. 19353.

Fighting large industrial fires, such as those involving storage tanks in petroleum refineries and petrochemical complexes, often requires foam solution discharges in the range of 5000 gallons per minute (GPM). Currently, foam solution discharge rates in this range require the use of four to five industrial foam pumpers at a cost of $175,000 to $200,000 each. Using state-of the-art equipment available on the market today, fighting a single fire can easily require a capital investment of up to $1,000,000.

Accordingly, conventional fighting of these large scale fires requires significant capital expenditures. Once the fire spreads, the possibility for ordering additional fire fighting equipment arises; the consequent delay hampers efficiency. It has therefore become desirable to devise an economical way of fighting large scale fires in an efficient and effective manner.

SUMMARY OF THE INVENTION

According to one aspect of the invention, a modular fire suppression apparatus includes a movable platform. A foam concentrate pump is mounted on the platform and has an inlet and an outlet. Means mounted on the platform, such as a diesel engine, are coupled to the pump for powering the pump. A foam generator, such as an in-line balanced pressure proportioning module (ILBP), on the platform has a water inlet, a foam concentrate inlet, and a foam solution outlet. The foam concentrate outlet is coupled to the outlet of the pump. A water intake manifold is mounted on the platform and has a plurality of water intakes. The intake manifold has an outlet coupled to the water inlet of the ILBP. A plurality of foam solution outlets are mounted on the platform and coupled to the foam solution outlet of the proportioner to deliver foam to the fire.

According to another aspect of the invention, the platform may comprise a skid, either alone or in combination with a wheeled vehicle, such as a trailer, with opposed first and second sides and a third side connecting the first and second sides. Each of the first and second sides has a plurality of foam solution discharge outlets, a foam concentrate intake line, and a foam concentrate return line. The third side, such as the rear of the trailer, is fitted with a water inlet manifold that is capable of coupling a plurality of water hoses to the inlet of the ILBP.

According to a third aspect of the invention, the mobile platform is connected to a foam concentrate supply vessel through an intake line and a return line. A plurality of water supply vehicles, such as standard municipal fire department pumper trucks, each has hoses connected to the water intake manifold. Fire hoses discharging the foam solution onto the fire may run from either side from the platform. Optionally, a foam monitor may be installed on the platform in order to obtain foam solution discharge directly from the platform itself. Where the platform is fitted with a foam concentrate return line, a pressure regulating valve is inserted into the line in order to insure that the pressure at the foam concentrate inlet of the ILBP is at or above a predetermined value.

The present invention confers several technical advantages over the prior art, which, in combination, yield an effective apparatus, system, and method of fighting large fires at costs substantially lower than have heretofore been known in the art. One important advantage is the ability to deliver quantities of fire suppression foam at a rate of 10,000 GPM. The invention is designed to deliver large quantities of foam solution to multiple dispensing appliances, including handlines, monitors, sprinklers, foam chambers, or high-back-pressure foam makers for sub-surface injection. The present invention is a solution to the problem of obtaining a large-volume foam delivery system which is both mobile and economical.

BRIEF DESCRIPTION OF THE DRAWINGS

Further aspects of the invention and their advantages will be discerned when one refers to the following detailed description as taken in conjunction with the drawings, in which.

Figure 2A:
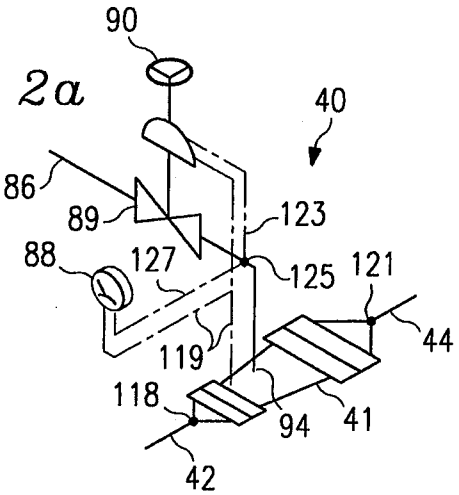
FIG. 2 is a schematic diagram of a first embodiment of a mobile modular foam fire suppression apparatus according to the invention.
Figure 2:
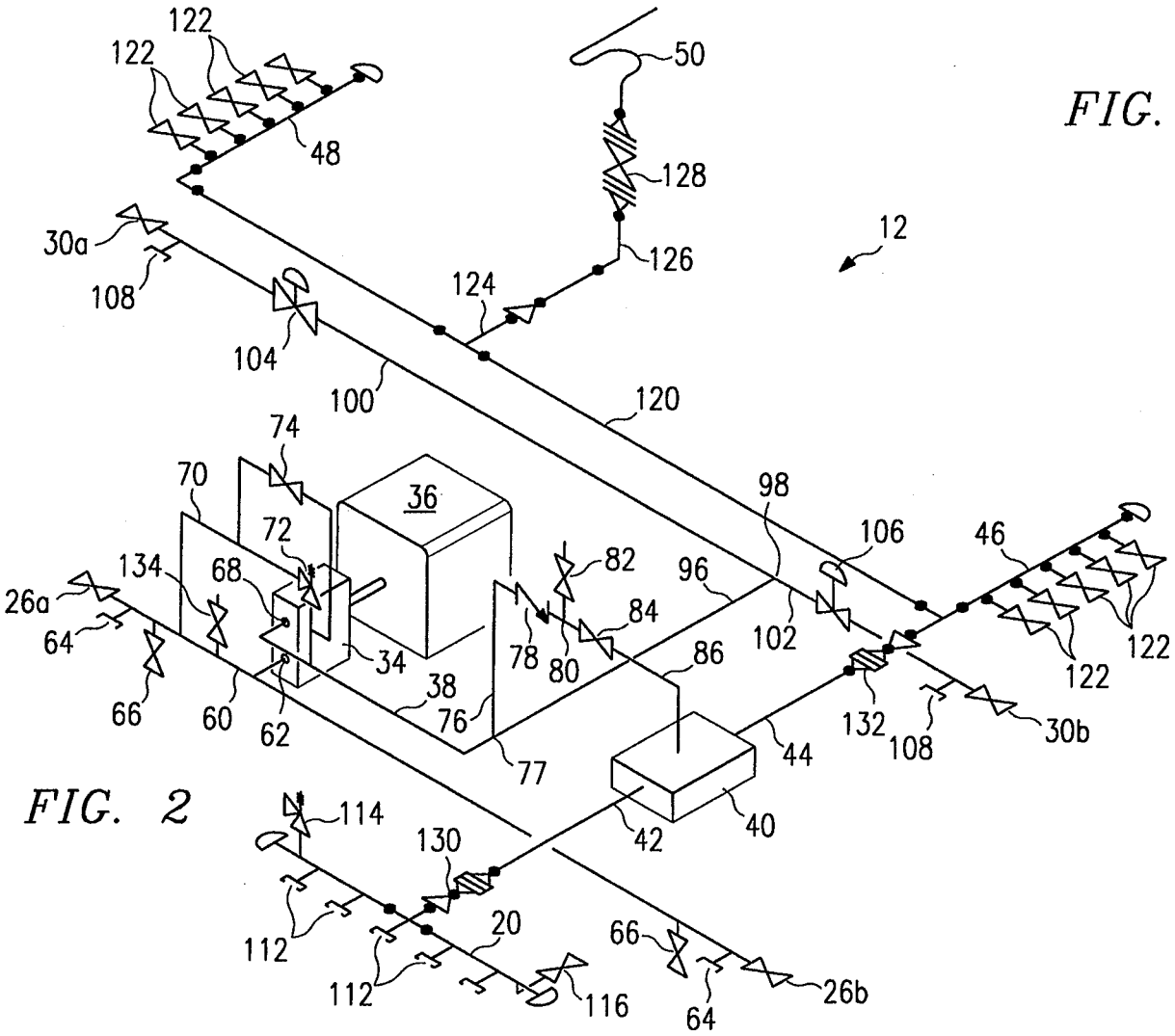
Figure 3:
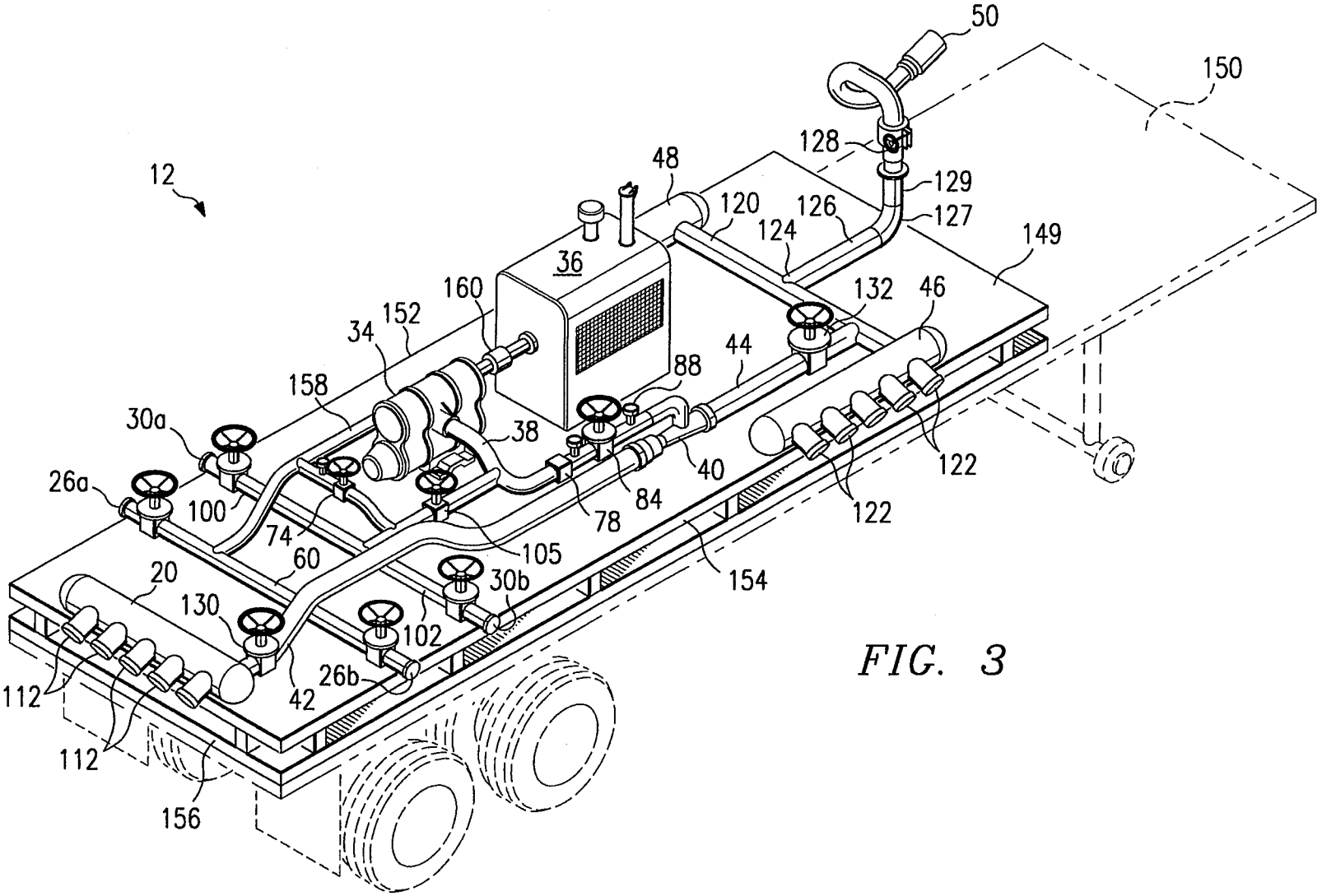
Figure 4:
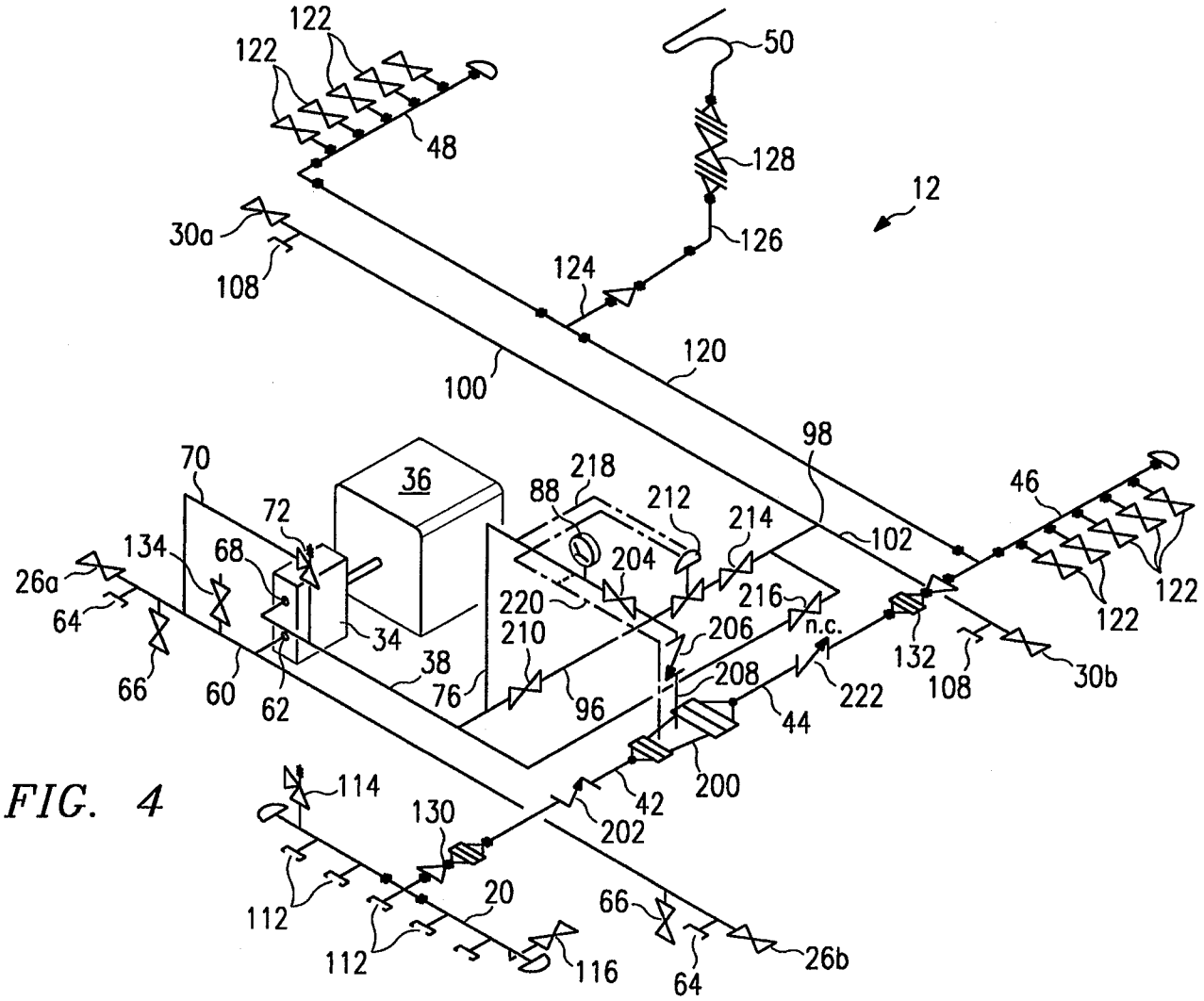

FIG. *2a* is a detail of FIG. 2 showing a foam/water proportioner and related valving, gauges, and connections, pressure sense lines being shown in dot-and-dashed line;

FIG. 3 is a perspective view of one possible physical layout of the major components of the apparatus schematically shown in FIG. 2; and FIG. 4 is a schematic diagram of a second embodiment of a mobile modular foam fire suppression apparatus according to the invention.

DETAILED DESCRIPTION OF THE INVENTION

Figure 1:
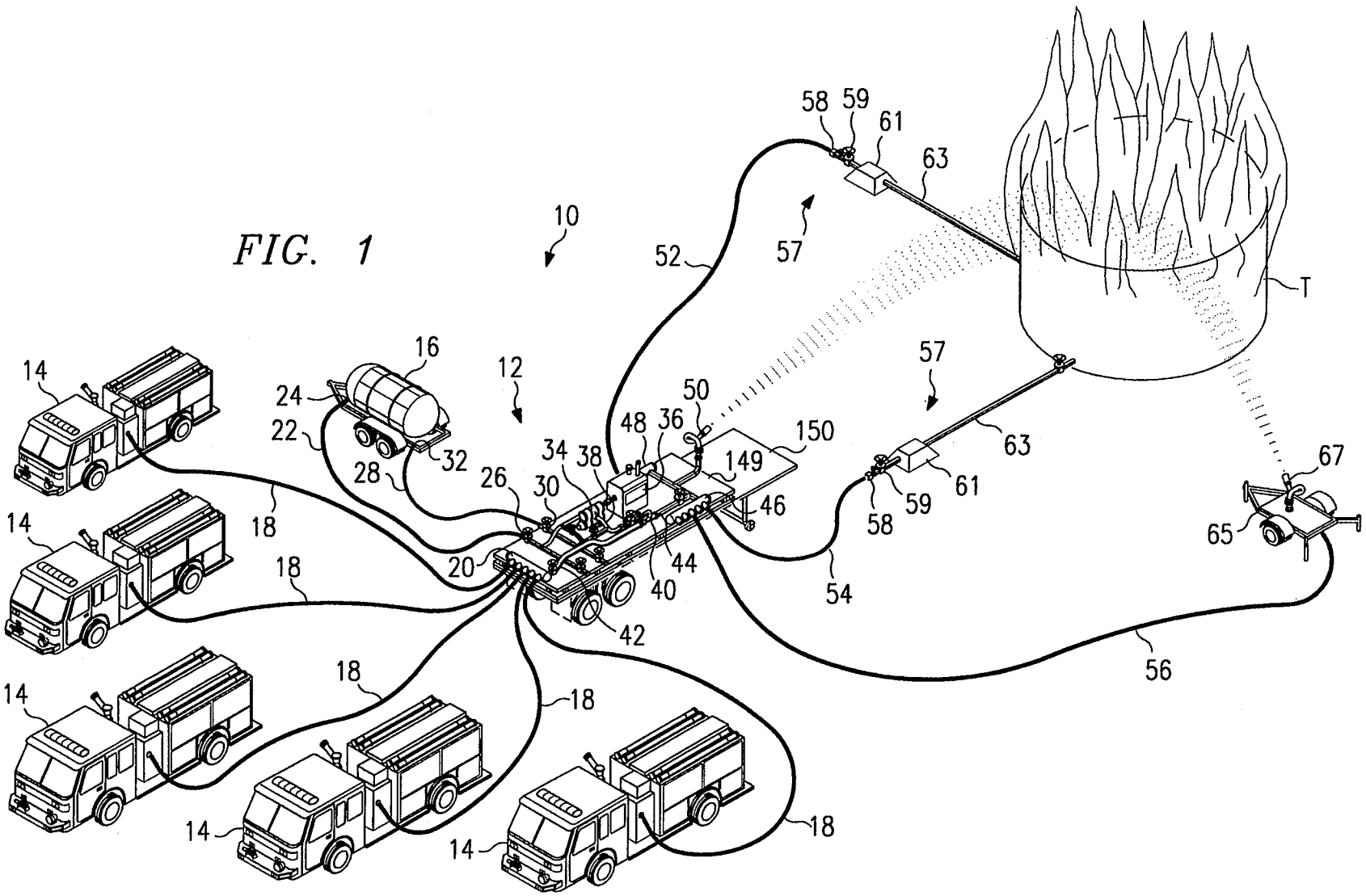
FIG. 1 is an isometric view of a firefighting scene showing a method of fighting a fire according to the invention.

FIG. 1 is an isometric view of a firefighting scene showing a method of fighting a fire according to the invention.

A fire-fighting system, indicated generally at 10, includes a mobile foam generator/pumper unit indicated generally at 12, a plurality of water pumper fire trucks 14, and a portable foam concentrate supply vessel 16. Each of the water pumper vehicles 14 has a 6" water hose 18 which extends from a respective water pump discharge outlet on the vehicle to a respective port of a water intake manifold 20 on unit 12. The water pumper vehicles 14 may be replaced by other pressurized water supplies, such as reservoirs with appropriate water pumping means, portable water vessels, or the like.

The foam concentrate supply vessel 16 is here shown as a wheeled trailer, although it may be a larger semi-trailer or a permanent storage structure. A foam concentrate intake line 22 runs from a discharge port 24 on the vessel 16 to a foam concentrate pump intake 26 on the unit 12. Excess foam concentrate that is not immediately used is discharged through a foam concentrate return hose 28, which is connected to a foam concentrate return line port 30 and an intake 32 on the foam concentrate supply vessel 16. Hose 22 should be a hard suction hose, of a variety normally carried on standard water pumpers. Hose 28 may be a 2" or 3" fire hose of the variety which is standard on fire-fighting equipment.

As will be described in more detail in conjunction with FIGS. 2 and 3, the foam concentrate is fed to an intake of a foam concentrate pump 34, which is preferably powered by an on-board diesel engine 36. A foam concentrate discharge 38 is fed to a water/foam proportioner 40, as is a conduit 42 from the water intake manifold 20. A foam solution discharge conduit 44 is connected to each of two foam solution outlet manifolds 46 and 48, and may be further connected to a monitor 50. Fire hoses, such as 5" flexible fire hoses 52, 54, and 56, may be connected to respective ones of a plurality of the foam solution outlets. Fire hoses 52 and 54 are here shown connected to back pressure foam makers indicated generally at 57. Each of the back pressure foam makers 57 will typically include a gate valve 58, a check valve 59, a pipe stanchion 61, and a length of preferably rigid pipe 63 which connects to a port on the tank T that is relatively low on the tank's side. Hose 56 is shown connected to a mobile monitor vehicle 65 having a large monitor 67 mounted thereon. The monitor 50 may be used to spray foam directly from the unit 12. In the illustrated embodiment, the unit 12 is shown mounted on a flatbed semitrailer. Other forms of the unit 12 are possible, such as a skid without a trailer but including lifting eyes, a framework bolted to a trailer which may be pulled by a pickup truck, and other mobile forms.

The foam concentrate intake port 26, the foam concentrate return port 30, and the foam solution outlet manifolds 46 and 48 are duplicated on both sides of the unit 12 to alleviate logistical and snarling problems.

Additionally, the diesel engine driver 36 disposed on the platform or trailer 12 powers only the foam pump 34. Conventional fire suppression devices, such as foam trucks, use a large diesel driver to drive both the foam pump and the vehicle which transports the apparatus. Using a small engine for one purpose provides for an efficient means of delivering large quantities of foam suppression material at high delivery rates and densities.

FIG. 2 is a schematic diagram of the mobile modular fire suppression apparatus indicated generally at 12. It should be understood that the apparatus 12 may stand alone as an independent mobile fire suppression apparatus, or it may be used in addition to a fixed system of fire suppression equipment to provide adequate capacity. It should also be understood that two modules 12 could be used on the same skid or trailer, side by side, sharing a single foam pump 34 for delivering quantities of foam solution up to 10,000 GPM.

Apparatus 12 has a positive displacement foam concentrate pump 34 preferably powered by a diesel engine 36. An end of a 3" foam concentrate inlet pipe 60 is connected to a foam concentrate inlet or intake 62 of the pump 34. Inlet pipe 60 carries foam concentrate from remote supply sources to the pump 34. Inlet pipe 60 is preferably branched to either side of the platform (see also FIG. 3) and is connected at its ends through gate valves **26*a* and 26*b* to foam concentrate supply sources, such as a tanker or nurse trailer (not shown; see FIG. 1). Two and one-half inch flush-in connections 64 and $\frac{3}{4}$" valve drains 66 are located near gate valves 26*a* and 26*b* of foam concentrate inlet pipe 60**.

A $2\frac{1}{2}$" rigid foam concentrate discharge pipe 38 has a first end connected to the discharge or outlet 68 of foam pump 34. Pipe 38 extends outwardly from the pump 34. A 3" foam concentrate pump bypass pipe 70 is connected between foam concentrate discharge line 38 and foam concentrate inlet pipe 60. A pressure release valve 72 is inserted into pump bypass line 70. A bypass valve 74 is inserted between points on pump bypass line 70 to circumvent valve 72 for ease in starting the engine 36 without a clutch.

A pipe segment 76 has a first end joined at a "T" connection or junction 77 with the foam concentrate discharge line 38. A second end of the pipe segment 76 is connected to a check valve 78. The check valve 78 is in turn connected to a pipe tee 80 having a pressure indicator 82. A valve 84 connects pipe tee 80 to a pipe segment 86, which in turn is connected to an in-line balanced pressure proportioning module indicated schematically at box 40.

A $2\frac{1}{2}$" diameter foam concentrate pipe segment 96 extends from union or "T" 77 to a union or "T" connection 98. From here, the foam concentrate return pipe system branches into a first $2\frac{1}{2}$" diameter pipe segment 100 which extends to a first side of the skid or vehicle, and a $2\frac{1}{2}$" diameter pipe segment 102 which extends to a second, opposite side of the platform or vehicle (see FIG. 3). In the illustrated embodiment, foam concentrate pipe segment 100 has a pressure regulating valve 104 which regulates the pressure of the foam concentrate fluid inside that portion of the foam concentrate return pipe segment 100 upstream of valve 104 at or above a predetermined pressure. This pressure is selected to be more than the pressure of the water introduced to the proportioner 40 discussed below. A similar pressure regulating valve 106 is inserted into the other lateral pipe segment 102, set to the same trigger pressure. In an alternative embodiment, the pressure regulating valves 104 and 106 are replaced by a single pressure regulating valve (not shown; see FIG. 3) somewhere in the foam concentrate return pipe segment 96 before it branches off to either lateral side of the vehicle or skid. In yet another embodiment, a "T" connection can be made to pipe 100 between valve 104 and flush-out connection 108, and an additional pipe segment (not shown) may be routed from this "T" connection back to the right side of the trailer, to make a connection to flush-out connection 108 and port 30*b*. The "T" connection 98 would be replaced with a left elbow, and valve 106 would be omitted.

In the illustrated embodiment, each lateral pipe segment 100 and 102 is equipped with a flush-out connection 108 and, preferably, a threaded hose termination 30*a* or 30*b* adaptable to be attached to lines running to one or more foam concentrate supply vessels (see FIG. 1).

The preferably 10" diameter water inlet pipe manifold 20 is capable of receiving water from up to five pressurized water sources, such as up to five municipal water pumper trucks, with five clappered 6" inlets 112. The inlets 112 for manifold 20 may have 5" Storz connections, and may be turned down 30° for ease in hose connection. At one end of manifold 20 is an auto air release 114. At this or the other end of manifold 20 is an auto drain 116.

A line 42, which should preferably be rigid pipe and at least 8" in diameter, connects the manifold 20 to the proportioner 40. The proportioning module 40 automatically balances the foam concentrate pressure with the water pressure to provide correct proportioning over a broad range of flow conditions, such as from 850 to 5000 GPM. A preferably 8" rigid foam solution discharge pipe 44 carries the resulting foam solution from the proportioner module 40 through a gate valve 132 to a 10" diameter rigid lateral foam solution discharge pipe 120. Branches of the foam solution discharge pipe 120 preferably extend to opposite sides of the skid or trailer (see FIG. 3). Ten inch foam solution outlet manifolds 46 and 48 are located at remote ends of the 10" lateral foam solution discharge pipe 120. Each manifold 46 and 48 has up to five 6" outlets 122 gated with 5" Storz connections and turned down 30° to be better adapted for connection to firefighting hoses.

Centrally located on lateral pipe 120 is a T-connection 124 that connects one end of a preferably 8" pipe 126. Pipe 126 is terminated by a valve 128 and a foam monitor or deck gun 50 mounted thereon. Monitor 50 allows the discharge of foam solution directly from the skid or vehicle.

FIG. 2*a* is a detail of the in-line balanced pressure proportioning module 40. Water pipe 42 connects to a water inlet port 118 of a ratio controller 41. Ratio controller 41 has a foam solution outlet 121 which is connected to foam solution discharge pipe 44. Foam concentrate pipe 86 is connected to a diaphragm pressure balancing valve 89 which is equipped with a manual override 90. The other side of balancing valve 89 is connected by a suitable pipe connection to a concentrate inlet 94 of the ratio controller 41. A water pressure sense line 119 is connected to a point on ratio controller 41 near the water inlet 118. Branches of the water pressure sense line 119 are connected to a duplex pressure gauge 88 and the diaphragm pressure balancing valve 89. A foam concentrate pressure sensing line 123, shown in dotted and dashed lines, is connected from a point 125 on the foam concentrate line 86 to the diaphragm pressure balancing valve 89. A branch 127 of the foam concentrate pressure sensing line may be connected from point 125, or a point close thereto, to the duplex pressure gauge gate 88. In the embodiment shown in FIG. 2*a*, the diaphragm pressure balancing valve 89 acts to balance the foam concentrate pressure at port 94 and the water pressure at port 118. In case there is a malfunction of valve 89, the manual override 90 is provided such that the difference in pressures between the foam concentrate in pipe 86 and the water in pipe 42 may be regulated manually.

Returning to FIG. 2, a manual valve 130 is inserted into line 42 between the water inlet 118 of the proportioning module and the water inlet manifold 20. Another valve 132 is placed in foam solution discharge pipe 44 before it meets with lateral foam solution discharge pipe 120. The pressure or vacuum of foam concentrate inlet line 60 may be measured with the assistance of a pressure indicating gauge 134.

Another embodiment utilizes two foam generators 40, such as in-line balanced pressure proportioning modules, on the same skid or vehicle, side by side. With these proportioners sharing the single foam pump 34, this apparatus can be sized to proportion any quantity of foam up to 10,000 GPM.

An exemplary physical layout of a unit 12 is isometrically shown in FIG. 3. In the illustrated embodiment, unit 12 includes a skid 149 which has been bolted onto a semitrailer 150. The unit 12 may also take the form of a skid mounted on a smaller trailer adaptable to be pulled by a pickup truck or may be mounted on a skid by itself and provided with lifting eyes such that the unit 12 may be emplaced by a construction crane or the like. It is preferred that the unit 12 be manufactured in the form of a skid which, according to the preference of the customer, may be bolted to any of various vehicles, or transported to the fire site by other methods.

The skid 149 has a left lateral side 152, a right lateral side 154, and a rear side 156. Each lateral side 152 and 154 is provided with a foam solution outlet manifold 46 or 48, a foam concentrate inlet 26*a* or 26*b*, and a foam concentrate return line outlet 30*a* or 30*b*. In this way, connections may be easily made to either side of the trailer, enhancing the ease of interconnection to other components of the system and diminishing snarling of the various hydraulic lines.

The foam concentrate lateral inlet line 60 is in this embodiment placed forwardly of the water inlet manifold 20. A pipe 158 is used to connect the foam concentrate inlet lateral pipe 60 to the inlet of foam pump 34. Next forward is the foam concentrate return lateral line 100. The foam pump 34, as connected to the diesel engine 36 by an appropriate axial connection 160, is sited forward of the foam concentrate lateral return line 100. A single pressure regulating valve 105, which replaces valves 104 and 106 as depicted in FIG. 2, is placed hydraulically between foam concentrate pump discharge line 38 and the lateral foam concentrate return line 100. Physically, it may be sited along side of the foam pump 34.

The proportioning module, schematically illustrated at 40, is placed along side the diesel engine 36. A foam solution discharge pipe 44 is connected to the lateral foam solution discharge pipe 120 that is in this embodiment located forward of the diesel engine 36. The outlet manifolds 48 and 46 are placed on the lateral sides 152 and 154 to have adequate clearance away from the foam concentrate inlet and outlet ports 26*a*, 26*b*, 30*a*, and 30*b*.

The illustrated embodiment of the invention is equipped with a monitor or deck gun 50. A "T" connection 124 is made to a pipe segment 126, which in turn is connected to an elbow 127. The elbow 127 is fitted to an upstanding pipe segment 129, which in turn is connected to the monitor valve 128. It is preferred to mount the water inlet manifold 20 at the rear of the trailer 150 to place the inlets 112 closest to the water pumper vehicles to which they will be connected, and to have these inlets spaced apart from the remaining inlets and ports on the trailer 150.

FIG. 4 is an isometric hydraulic line diagram of an alternative embodiment of the invention. In this embodiment, the in-line balanced pressure proportioner 40, the duplex gauge 88, and manual override 90 and the pressure regulating valves 104 and 106 (see FIGS. 2 and 2*a*) are replaced by a ratio controller 200 and associated equipment. The 8" line 42 connects the manual valve 130 to a check valve 202, and connects check valve 202 to a water inlet of the ratio controller 200. The 2½" foam concentrate discharge pipes 38 and 76 connect the foam concentrate discharge of foam pump 34 to a valve 204, which in turn is connected to a check valve 206. Check valve 206 is connected by an 8" line 208 to a foam concentrate inlet of the ratio controller 200. As water passes through a jet at the inlet of the ratio controller 200, it creates a reduced pressure area between the jet and the downstream section called a throat or receiver. This reduction in pressure causes foam liquid to flow through a foam liquid metering orifice and into the reduced pressure area.

As the water flow through the ratio controller 200 increases, so does the level of pressure reduction, thereby affecting a corresponding pressure drop across a foam solution metering orifice of the ratio controller 200. This corresponding pressure drop results in a foam:solution flow which is proportionate to the water flow through the ratio controller 200. As the water and foam liquid concurrently flow into a common reduced pressure area, it is necessary only to maintain identical water and foam liquid pressures at the respective inlets of the ratio controller 200. The foam solution metering orifice of the ratio controller 200 is connected to foam solution outlet pipe 44.

A valve 210 is inserted into foam concentrate line 96 before a diaphragm control valve 212. Another gate valve 214 is inserted into the line 96 between the diaphragm control valve 212 and the T-connection 98 to the lateral foam concentrate return lines 100 and 102. A normally closed bypass valve 216 is connected from a point before the valve 210 to a point after the gate valve 214.

A foam concentrate sense line, shown by a dotted and dashed line 218, is connected between the foam concentrate line 76 and a port on the diaphragm control valve 212. The foam concentrate sense line is of relatively small diameter. This or another foam concentrate sense line may be connected to duplex gauge 88. A water pressure sense line 220, also of relatively small diameter and also shown by a dotted and dashed line, is connected to a port on the diaphragm control valve 212, the duplex gauge 88, and a sense port on the ratio controller 200. A check valve 222 is inserted into line 44 between the foam solution outlet of ratio controller 200 and the foam solution valve 132.

In operation, equal pressures are maintained by the automatic diaphragm control valve 212 in order to assure proper mixing of the water at the water inlet ratio controller 200 and foam concentrate at the foam concentrate inlet thereof.

This apparatus can be sized to produce five different solution flow rates using ratio controllers available in the market: 152 to 180 GPM, 70 to 450 GPM, 150 to 1200 GPM, 1520 to 2500 GPM, and 850 to 5000 GPM.

In summary, the invention is designed to deliver large quantities of 3% foam solution to multiple dispensing appliances, including lines connected to one or more monitors 50 or 67, sprinklers, foam chambers, or high back-pressure foam makers 57 for subsurface injection. The apparatus allows up to five standard water pumper fire trucks to hook up to the water inlet manifold 20 and provide large quantities of water necessary for high capacity foam solution delivery. Water supplied to the 10" water inlet manifold 20 may be from standard water pumpers pumping at a combined rate of up to 5000 GPM.

While preferred embodiments of the invention have been disclosed in the above detailed description, the invention is not limited thereto but only by the scope and spirit of the appended claims.

What is claimed is:

1. A mobile modular foam fire suppression apparatus, comprising:

a movable platform;

a remote foam concentrate supply;

a foam concentrate pump mounted on said platform and having an inlet and an outlet, and operable to pump the foam concentrate of said remote foam concentrate supply from said inlet to said outlet;

means mounted on said platform and coupled to said pump for powering said pump;

an in-line balanced pressure proportioning module having a water inlet, a foam concentrate inlet, and a foam solution outlet, said module being mounted on said platform, said foam concentrate inlet being coupled to said outlet of said pump;

a water intake manifold mounted on said platform and having a plurality of water intakes, said intake manifold having an outlet coupled to said water inlet of said proportioning module;

a plurality of foam solution outlets mounted on said platform and coupled to said foam solution outlet of said proportioning module; and a first foam concentrate conduit coupling said outlet of said pump to said foam concentrate inlet of said module, a foam concentrate return conduit having a first end communicating with said pump outlet and at least one second end, said second end being operable to be coupled to said remote supply of the foam concentrate for delivery of the foam concentrate thereto, and a pressure regulator interposed between said first end and said second end of said foam concentrate return conduit for regulating the fluid pressure of the foam concentrate in a portion of said return conduit between said first end and said pressure regulator.

2. The mobile modular fire suppression apparatus of claim 1, comprising a foam concentrate bypass pipe having a first end coupled to said outlet of said pump and at least one second end coupled to said inlet of said pump, said bypass pipe including a pressure relief valve along its length.

3. The apparatus of claim 1, wherein said platform has first and second opposed sides, said foam concentrate return conduit having a first branch connected to said second end and mounted adjacent said first side of said platform, and a second branch of said return conduit having a third end remote from said first and second ends and mounted adjacent said second side of said platform.

4. Mobile modular fire suppression apparatus, comprising:

a movable platform;

a foam concentrate pump mounted on said platform and having an inlet and an outlet, a foam concentrate intake conduit being coupled to said inlet and adaptable to be coupled to a foam concentrate supply remote from said platform, said pump being operable to draw foam concentrate from said supply;

a foam generator mounted on said platform, a foam concentrate inlet of said foam generator being coupled to said outlet, said foam generator having a water inlet and a foam outlet, a water intake conduit being coupled to said water inlet and adapted to be coupled to at least one pressurized water supply remote from said platform;

a foam discharge conduit coupled to said foam outlet of said foam generator; and a foam concentrate return conduit having a first end coupled to said outlet of said foam concentrate pump and a second end adapted to be coupled to said foam concentrate supply, means being inserted in said foam concentrate return conduit for regulating the pressure thereof between said first end and said means to be at the water pressure in said water intake conduit.

5. The fire suppression apparatus of claim 4, and further comprising a foam concentrate return port coupled to said foam concentrate return conduit and a foam concentrate intake port coupled to said foam concentrate intake conduit, at least one flush-out connection being mounted near said foam concentrate return port, and at least one flush-in connection being mounted near said foam concentrate intake port.

6. The apparatus of claim 4, wherein said foam generator is an in-line balanced pressure proportioning module, said means for regulating the pressure in said foam concentrate return conduit regulating the pressure thereof between said first end of the foam concentrate return conduit and said means to be at the pressure of water entering said in-line balanced pressure proportioning module.

7. Mobile modular fire suppression apparatus, comprising:

a platform having first and second opposed sides;

a foam concentrate pump mounted on said platform and having an inlet and an outlet;

a branched foam concentrate intake conduit having a first end mounted adjacent said first side, a second end mounted adjacent said second side, and a third end coupled to said inlet of said foam concentrate pump;

said first and second ends each adaptable to be coupled to at least one supply of foam concentrate remote from said platform;

means for generating foam mounted on said platform and having a foam concentrate inlet coupled to said outlet of said pump, a foam outlet, and a water inlet;

a pressured water intake conduit coupled to said water inlet of said means for generating and adaptable to be coupled to a pressured water supply remote from said platform; and a foam discharge conduit coupled to said means for generating foam.

8. Mobile modular fire suppression apparatus, comprising:

a movable platform having opposed first and second sides;

a foam concentrate pump mounted on said platform and having an inlet and an outlet, a foam concentrate intake conduit being coupled to said inlet and adaptable to be coupled to a foam concentrate supply remote from said platform, said pump being operable to draw foam concentrate from said supply;

a foam generator mounted on said platform and having a foam concentrate inlet, a water inlet, and a foam outlet, a water intake conduit being coupled to said water inlet and adapted to be coupled to at least one pressurized water supply remote from said platform; and a branched foam discharge conduit having a first end coupled to said foam outlet of said foam generator, a second end mounted adjacent said first side, and a third end mounted adjacent said second side.

9. The apparatus of claim 8, and further comprising a foam concentrate return conduit having a first end coupled to said outlet of said foam concentrate pump and a second end adaptable to be coupled to said foam concentrate supply.

10. The apparatus of claim 8, wherein said foam generator is an in-line balanced pressure proportioning module.

11. Mobile modular fire suppression apparatus, comprising:

a movable platform having opposed first and second sides;

a foam concentrate pump mounted on said platform and having an inlet and an outlet, a foam concentrate intake conduit being coupled to said inlet and adaptable to be coupled to a foam concentrate supply remote from said platform, said pump being operable to draw foam concentrate from said supply;

a foam generator mounted on said platform and having a foam concentrate inlet, a water inlet, and a foam outlet, said foam concentrate inlet being coupled to said outlet of said foam concentrate pump, a water intake conduit being coupled to said water inlet and adapted to be coupled to at least one pressurized water supply remote from said platform;

a branched foam concentrate return conduit having a first end coupled to said outlet of said foam pump, a second end mounted adjacent said first side, and a third end mounted adjacent said second side, said first and second ends being adaptable to be coupled to at least one remote foam concentrate supply; and a foam discharge conduit coupled to said foam outlet of said foam generator.

12. The apparatus of claim 11, and further comprising means disposed in said foam concentrate return conduit between said first end and said second and third ends for regulating the pressure thereof between said first end and said means for regulating, such that the last said pressure will be at the water pressure in said water intake conduit.

13. The apparatus of claim 11, wherein said foam generator is an in-line balanced pressure proportioning module.

14. Mobile modular foam fire suppression apparatus comprising:

a movable platform;

a foam concentrate pump mounted on said platform and having an inlet and an outlet, and operable to pump foam concentrate from said inlet to said outlet;

means mounted on said platform and coupled to said pump for powering said pump;

an in-line balanced pressure proportioning module mounted on said platform and having a water inlet, a foam concentrate inlet, and a foam solution outlet, said foam concentrate inlet being coupled to said outlet of said pump;

a water intake manifold mounted on said platform and having a plurality of water intakes, said intake manifold having an outlet coupled to said water inlet of said proportioning module;

a plurality of foam solution discharge outlets mounted on said platform and coupled to said foam solution outlet of said proportioning module; and a foam concentrate intake conduit coupled to said inlet of said pump, said conduit being operable to be connected to a remote supply of foam concentrate for intake of the foam concentrate therefrom, said platform having two opposed first and second sides and a rear side connecting said first and second sides, a first branch of said foam concentrate intake conduit having an end mounted adjacent said first side, a second branch of said foam concentrate intake conduit having an end mounted adjacent said second side, and said water intake manifold being mounted adjacent said rear side.

15. Mobile modular foam fire suppression apparatus comprising:

a movable skid;

a foam concentrate pump mounted on said skid and having an inlet and an outlet, and operable to pump foam concentrate from said inlet to said outlet;

means mounted on said skid and coupled to said pump for powering said pump;

an in-line balanced pressure proportioning module mounted on said platform and having a water inlet, a foam concentrate inlet, and a foam solution outlet, said foam concentrate inlet being coupled to said outlet of said pump;

a water intake manifold mounted on said skid and having a plurality of water intakes, said intake manifold having an outlet coupled to said water inlet of said proportioning module;

a plurality of foam solution discharge outlets mounted on said skid and coupled to said foam solution outlet of said proportioning module; and a foam concentrate intake conduit coupled to said inlet of said pump, said conduit being operable to be connected to a remote supply of foam concentrate for intake of the foam concentrate therefrom, said skid having two opposed sides, a first branch of said foam concentrate intake conduit having an end mounted adjacent a first of said sides, and a second branch of said foam concentrate intake conduit having an end mounted adjacent a second of said sides.

* * * * *